US010538258B2

(12) United States Patent
Wennekamp

(10) Patent No.: US 10,538,258 B2
(45) Date of Patent: Jan. 21, 2020

(54) METHOD FOR STABILIZING A RAIL VEHICLE

(71) Applicant: SIEMENS AG, Munich (DE)

(72) Inventor: Fabian Wennekamp, Essen (DE)

(73) Assignee: Siemens Mobility GmbH, Munich (DE)

( * ) Notice: Subject to any disclaimer, the term of this patent is extended or adjusted under 35 U.S.C. 154(b) by 431 days.

(21) Appl. No.: 15/325,624

(22) PCT Filed: Jul. 14, 2015

(86) PCT No.: PCT/EP2015/066033
§ 371 (c)(1),
(2) Date: Jan. 11, 2017

(87) PCT Pub. No.: WO2016/008871
PCT Pub. Date: Jan. 21, 2016

(65) Prior Publication Data

US 2017/0158212 A1 Jun. 8, 2017

(30) Foreign Application Priority Data

Jul. 16, 2014 (DE) ..... 10 2014 213 863

(51) Int. Cl.

| | |
|---|---|
| ***B61L 15/00*** | (2006.01) |
| ***B61F 5/24*** | (2006.01) |
| ***B61K 9/12*** | (2006.01) |
| ***B61L 23/04*** | (2006.01) |
| ***B61L 25/02*** | (2006.01) |

(52) U.S. Cl.

CPC ..... *B61L 15/0081* (2013.01); *B61F 5/245* (2013.01); *B61K 9/12* (2013.01); *B61L 23/042* (2013.01); *B61L 25/021* (2013.01); *B61L 25/025* (2013.01); *B61L 2201/00* (2013.01); *B61L 2205/04* (2013.01)

(58) Field of Classification Search

CPC ..... B61L 15/0081; B61F 9/005; B61K 9/12
USPC ..... 246/169 R
See application file for complete search history.

(56) References Cited

U.S. PATENT DOCUMENTS

| | | | |
|---|---|---|---|
| 6,860,453 B2 | 3/2005 | Moretti | |
| 9,733,625 B2 | 8/2017 | Kumar et al. | |
| 2007/0219680 A1* | 9/2007 | Kumar | B61L 3/006 701/19 |

(Continued)

FOREIGN PATENT DOCUMENTS

| | | |
|---|---|---|
| CN | 1267611 A | 9/2000 |
| CN | 101374714 A | 2/2009 |

(Continued)

OTHER PUBLICATIONS

Zhang Hui, "The Implement of Speed Control Function in Ato System by Using Semi-Physical Simulation Method", Master's Thesis at Southwest Jiaotong University, Jul. 1, 2012—English abstract on p. 3.

*Primary Examiner* — Zachary L Kuhfuss
(74) *Attorney, Agent, or Firm* — Laurence Greenberg; Werner Stemer; Ralph Locher

(57) ABSTRACT

In a method for stabilizing a rail vehicle with a wheel set, the speed of the rail vehicle is changed when a critical vibration state of the wheel set occurs. An advantageous state can be achieved if the speed of the rail vehicle is changed by using a vibration state variable of the wheel set.

15 Claims, 6 Drawing Sheets

(56) References Cited

U.S. PATENT DOCUMENTS

| | | | | |
|---|---|---|---|---|
| 2007/0299630 | A1 | 12/2007 | Zoll et al. | |
| 2010/0241296 | A1* | 9/2010 | Rhea, Jr. | B60T 13/665 701/20 |
| 2014/0116826 | A1* | 5/2014 | Ogawa | B61F 5/245 188/266.2 |

FOREIGN PATENT DOCUMENTS

| | | | |
|---|---|---|---|
| DE | 10320342 | B3 | 4/2004 |
| DE | 102004045457 | B4 | 4/2009 |
| DE | 102010052667 | A1 | 5/2012 |
| EP | 2436574 | A1 | 4/2012 |
| RU | 83469 | U1 | 6/2009 |
| RU | 87680 | U1 | 10/2009 |
| RU | 97690 | U1 | 9/2010 |
| WO | 0194176 | A1 | 12/2001 |

* cited by examiner

METHOD FOR STABILIZING A RAIL VEHICLE

BACKGROUND OF THE INVENTION

Field of the Invention

The invention relates to a method for stabilizing a rail vehicle having a wheel set, wherein the speed of the rail vehicle is changed if a critical vibration state of the wheel set occurs.

Rail vehicles usually have wheels that are rigidly connected by an axle to form a wheel set. For guidance on a rail, the wheels usually have conical profiles whose external diameters taper toward the outer side of the vehicle. Despite the wheels being rigidly connected in pairs, this kind of profiling enables curves to be negotiated with low wear and noise, as radius-related differences in the distance traveled by inner and outer wheels through the curve can be compensated by rolling motions on different external diameters.

When the vehicle is traveling at high speed on a straight track or negotiating large-radius curves, a wheel set profiled in this way may enter a critical vibration state. Said wheel set makes periodic lateral movements—i.e. at right-angles to the direction of travel—which can result in safety-critical instability of the rail vehicle. The instability thus caused may be accompanied in particular by excessive stress being applied to the track bed or by passenger comfort being impaired.

BRIEF SUMMARY OF THE INVENTION

The object of the invention is to specify a method which enables a rail vehicle to be reliably stabilized.

This object is achieved by a method of the type mentioned in the introduction, wherein the speed of the rail vehicle is inventively changed using a vibration state variable of the wheel set.

The invention is based on the insight that a long-lasting speed reduction to a predetermined value—which can be 180 km/h or less for a high-speed train—can adversely affect timekeeping and the availability of the rail vehicle. By means of the invention, the speed is changed using the vibration state variable, so that the change can be made functionally dependent on the vibration state variable. The change can likewise vary as a function of the vibration state variable with variations in the vibration state variable. Therefore, a change in speed that is commensurate in terms of duration, type and/or magnitude with the actual instances of the critical vibration state can be achieved for stabilizing the rail vehicle. On the one hand, a safety requirement can be met in this way and, on the other hand, an excessive speed reduction in terms of duration and magnitude can be avoided. In particular, the speed can be increased again after a reduction, particularly as a function of the vibration state variable, thereby achieving better timekeeping, i.e. train punctuality.

Rail vehicle stabilization within the meaning of the invention may be understood as attenuation of a lateral vibration of at least one wheel set of the rail vehicle. This attenuation can be achieved by reducing vibration excitation forces, changing vibration damping or similar.

The wheel set can comprise two wheels interconnected via an axle or shaft. The wheel set can be mounted on a truck (bogie). Preferably two wheel sets are mounted on a truck. The truck can be disposed on the underside of the rail vehicle and pivot about a vertical axis of the rail vehicle. The truck preferably comprises a damper—also known as a hydraulic hunting damper—for damping rotational motion of the truck.

A critical vibration state of the wheel set can be understood as meaning a vibration state in which the vibration state variable, e.g. an acceleration, has reached and/or exceeded a predetermined limit value in absolute terms. The predetermined limit value may be defined in an applicable standard.

A vibration state variable can be a time-dependent physical variable—e.g. a deflection, a velocity or an acceleration—which unambiguously describes a state of a periodically moving system, possibly in conjunction with another variable. The stabilization of the rail vehicle may involve an absolute value reduction in the vibration state variable of the wheel set vibration.

A vibration S(t) of the rail vehicle is dependent on the speed v(t) of the rail vehicle as well as other parameters such as track direction, track condition, equivalent conicity, side wind, loading of the rail vehicle and similar: $S(t)=f(v(t), \ldots, t)$. Because of its high variability, the function $f(v(t), \ldots, t)$ is difficult to define analytically. Expediently stored in a control unit of the rail vehicle, however, is a function □ which specifies a functional relationship between the vibration state variable s and the speed of the rail vehicle, particularly with the speed as a dependent variable v=□(s), where v and s can in turn be dependent on the time t and □ and other variables. The function □ expediently gives different speeds v for different absolute values of the vibration state variable s, wherein each vibration state variable s can be unambiguously assigned a speed v. Instead of the speed v, the change in speed dv/dt or rather v' can be used. The change in the speed v of the rail vehicle, i.e. the speed gradient and/or the endpoint of the change, i.e. the target speed, is expediently changed using the function □, so that, if a critical vibration state is present, the reduction takes place as a function of the vibration state variable according to the function □. Different absolute values of the vibration state variable can therefore produce different changes in the speed.

The speed change preferably takes place at least largely automatically, i.e. avoiding manual intervention by a driver. In this way, an excessive reduction in terms of duration and absolute value, i.e. magnitude—that is to say, a reduction over and above a time-related and/or absolute value reduction sufficient to stabilize the rail vehicle—is avoided and an achievable maximum speed of the rail vehicle is increased, thereby improving timekeeping, i.e. punctuality.

In an advantageous embodiment of the invention, the vibration state variable is used as a controlled variable for changing the speed. The speed is expediently changed such that the vibration state variable is below the predetermined limit value in absolute terms. The vibration state variable is preferably acquired at predetermined time intervals, preferably continuously or quasi-continuously. The vibration state variable is expediently compared with a set point value and the speed is changed as a function of a difference between the set point value and the measured value of the vibration state variable. It is advantageous if the speed is changed within a control loop for controlling the vibration state variable. The speed can be a manipulated variable within a control loop.

In another embodiment, the vibration state variable is an acceleration. The acceleration can be in particular an acceleration essentially at right angles to the direction of travel of the rail vehicle, i.e. a transverse or lateral acceleration. The acceleration can be an acceleration of an element of the rail vehicle, in particular of a wheel, a wheel set or a truck.

The acceleration is expediently determined on the truck of the rail vehicle. It is also conceivable for the acceleration to be determined on a wheel set, a wheel and/or another element of the rail vehicle. It can be determined via a measuring device designed for this purpose. The measuring device can have a sensor, preferably a piezoelectric acceleration sensor. The vibration state variable can be advantageously determined using a displacement transducer, particularly in combination with a time measuring device.

In an advantageous further development of the invention, the speed is increased if the rail vehicle has remained within a non-critical vibration state range of the wheel set over a predefined travel span. Travel span within the meaning of the invention can be understood as a duration or a length of run, generally a period of time or a distance covered. For example, the predefined travel span can be a period of 30 min, a distance of 50 km or the like. It is advantageous if a plurality of travel spans are predefined, particularly as a function of a current speed of the rail vehicle.

Expressed in a greatly simplified manner, the method can be designed such that the speed is reduced in the event of a critical vibration state of the wheel set occurring e.g. at 275 km/h until the rail vehicle has been stabilized or rather the vibration state variable has been sufficiently reduced. The speed reduced in this way can be, for example, 254.5 km/h. If the rail vehicle completes a predefined travel span, e.g. 20 km, without a new critical vibration state occurring, the speed is increased again. In this way, any schedule deviation of the rail vehicle, i.e. time lost as a result of the preceding instability-caused speed reduction, can be minimized and the punctuality of the rail vehicle increased.

The instability can be affected by on-board and/or track-related variables. For example, a worn or damaged section of track can influence the occurrence of a critical vibration state. Specifying the travel span until the speed is increased again prevents, in particular, repeatedly occurring critical vibration states on such a section of track as a result of the speed being increased prematurely.

Expediently, the speed is not increased again unless the rail vehicle has covered the travel span at a predefined average speed. The average speed can be, for example, between 70% and 80%, preferably between 80% and 95%, of a speed achieved immediately after a speed change according to the method. This can prevent the speed from being increased prematurely, i.e. before a sufficiently large distance has been covered, and a critical vibration state being re-triggered by excessively fast running on a worn section of track, for example.

The vibration state or the vibration of the wheel set can be significantly affected by the forces acting on the wheel set or more specifically the wheels thereof. In particular, braking of the rail vehicle and the associated wheel/rail friction can affect wheel set vibration. It may therefore happen that the rail vehicle is stabilized by a braking operation and the accompanying speed reduction, but a critical vibration state immediately re-occurs once the braking force has been at least largely reduced—i.e. when the brake is at least partially released.

In particular, it has therefore been found to be advantageous to determine a maximum rail vehicle speed that is different from the changed speed as a function of the changed speed. Expediently, this maximum speed is lower than the changed speed, thereby providing a simple means of preventing the occurrence of a critical vibration state as the result of a partial or complete reduction in the braking force.

It is expedient to determine the maximum speed as the changed speed multiplied by a safety factor. The safety factor can be between 0.85 and 0.95, preferably between 0.95 and 0.99. Particularly with a safety factor of 0.98, sufficient stabilization of the rail vehicle can be achieved with a minimal additional reduction in speed.

The maximum speed is advantageously limited to a travel span, so that, once that distance is covered or that time has elapsed, the speed can be increased beyond the maximum speed.

To summarize and express the above in simplified terms, the method can be designed such that, if a vibration-induced instability occurs, the speed is reduced until the rail vehicle is stabilized and an appropriate maximum speed or rather a speed restriction is determined and expediently set as a function of the vibration state variable.

If within a particular travel span—this can be a distance covered or a period of time—no new instability occurs, the last speed restriction imposed is lifted. According to the method, a plurality of speed restrictions can be set consecutively during a journey involving a plurality of unstable states. To increase the speed, it has proved to be advantageous for speed restrictions to be removed consecutively after the predetermined travel span has been passed—i.e. beginning with the last one set, then the penultimate one set, etc. In this context, this can be seen as the rail vehicle coming close to the speed which only just permits a stable driving state.

In another advantageous embodiment, the speed is continuously reduced until the vibration state variable falls below a predetermined limit value. Continuous in this context means that the rail vehicle is braked with a non-negligible speed gradient to a speed that is unknown at the start of the braking operation. This ensures that the speed is reduced by no more than is necessary to stabilize the rail vehicle. The predetermined limit value can be defined in an applicable standard and/or be an empirical value In an advantageous further development, the speed is reduced, the vibration state variable is measured during the reducing of the speed and the speed is reduced until such time as the vibration state variable falls below a predetermined limit value as a result of the reduction of the speed.

It is also advantageous if the speed is changed to one or successively more discrete speed values, i.e. incrementally. Advantageously the speed is changed to speed values equally distributed over a speed interval. The speed values can be spaced 50 km/h apart, preferably 10 km/h apart, within the speed interval. For example, between 210 km/h and 330 km/h, the speed interval can have the discrete intermediate values 300 km/h, 270 km/h and 240 km/h. This enables simplified implementation of the method to be achieved, in particular simplified translation of parts of the method into software program code.

It may be desirable to bring about stabilization of the rail vehicle whilst minimizing inevitably occurring disturbance variables. Such disturbance variables can be, in particular, forces applied to the wheel set that occur in an impulsive, fluctuating, transient or similar manner. It is therefore advantageous for the speed to be reduced with a constant time lag. In this way, a steadying of the braking forces acting on the wheel set during braking can be achieved. Consequently, braking force variations as a disturbance variable affecting the stabilization of the rail vehicle are minimized.

It is also desirable to counteract a repeated change between a stable and an unstable driving state of the rail vehicle, i.e. between a non-critical and a critical vibration state of the wheel set. Such state changes can produce a sawtooth, zig-zag and/or wavelike speed characteristic of the rail vehicle and are undesirable from a technical and economic point of view.

In particular, it is therefore advantageous for the speed to be permanently reduced to a predefined speed value in the event of repeated occurrence of a critical vibration state of the wheel set.

Advantageously, the speed is reduced to a predefined speed value if a critical vibration state occurs repeatedly within a speed interval.

In addition, it has proved advantageous for the speed to be reduced to a predefined speed value if a critical vibration state occurs repeatedly on one and the same wheel set of the rail vehicle.

Critical vibration states may occur repeatedly within a speed interval and/or on one and the same wheel set if they are influenced at least largely by a vehicle-related variable. Such a variable can be wear on a wheel, wheel set, truck or the like. In particular, the state of wear of a truck damper, a wheel or wheel set bearing or similar may contribute to the occurrence of a critical vibration state.

Advantageously, the speed is permanently reduced e.g. until a next scheduled stop, preferably until the next maintenance of the rail vehicle. This enables speed-induced overstressing of worn components and/or safety-critical driving states of the rail vehicle to be prevented from occurring.

It is possible that usual driving states of the rail vehicle at low or moderate speeds, e.g. negotiating a switch at 100 km/h, will briefly result in lateral vibrations of the wheel set. Particularly in order to prevent a method-related, in particular automatic speed change from being performed as a result of such driving states, it is advisable for the speed to be changed only if a critical vibration state of the wheel set occurs above a predetermined minimum speed. The predetermined minimum speed can be between 160 and 200 km/h, preferably between 200 and 220 km/h.

In another embodiment, the speed of the rail vehicle is changed using GPS information for the current position of the rail vehicle. For example, using GPS information for the current position of the rail vehicle, a position for initiating braking, a deceleration value, an acceleration value or similar can be determined for optimized stabilization of the rail vehicle.

Using rail vehicle position information, e.g. from GPS, GLONASS or Galileo information, can be particularly advantageous in conjunction with stored position information if a critical vibration state occurs. In addition, the use of position information in conjunction with stored information can be advantageous for locating a damaged, worn, or generally critical section of track that may promote instability of the rail vehicle. To determine the position of the rail vehicle, a characteristic element of the route or a location-finding feature installed on the route or a location-finding system can be used.

It is also conceivable for the occurrence of a critical vibration state or an unstable driving state to be prevented using the location or position information, e.g. by early braking of the rail vehicle before a known critical section of track or similar. This enables the rail vehicle to be stabilized in a manner tailored to the lie of the track.

In another advantageous embodiment of the invention, the speed of the rail vehicle is changed using a measuring signal of an on-board track monitoring device. The track monitoring device can be an instrument for detecting a rail profile or track geometry defect. A track geometry defect can be a deviation of the position of a track from a nominal position in a horizontal or vertical direction. A track geometry defect can also be a defect in the cross-level of two rails forming the track, which can arise during construction or due to changes in the track substructure.

The measuring signal can be used as a variable for determining a deceleration or acceleration matched to a current track state represented by the measuring signal. The measuring signal can be used as a variable in a control loop for changing the speed. In addition, the measuring signal can be used as a variable in a control loop for determining a manipulated variable, in particular of an acceleration or deceleration, for stabilizing the rail vehicle. From the rail profile, the deviation of the profile from a nominal profile and/or the equivalent conicity can be determined.

This provides a simple means of achieving an improved reaction—i.e. tailored to the current state of the track—for stabilizing the rail vehicle in the event of a critical vibration state occurring.

It is also advantageous for the rail vehicle's damping to be changed. The damping can be that provided by a truck damper, a wheel or wheel set damper or similar of the rail vehicle. If a critical vibration state occurs, changing the damping—in addition to changing the speed of the rail vehicle—can be used as an additional means of stabilizing the rail vehicle.

It is possible here for the speed to be changed first and then the damping. It may also be advantageous for the damping to be changed first and the speed thereafter. It is also conceivable for both actions to be performed simultaneously.

The invention also relates to an arrangement for stabilizing a rail vehicle comprising a wheel set and a drive unit for accelerating and/or decelerating the rail vehicle, having a determining device for determining a vibration state variable (66) of the wheel set.

The arrangement inventively has a control unit designed to control the drive unit using the vibration state variable of the wheel set for changing the speed of the rail vehicle.

The foregoing description of advantageous embodiments of the invention contains numerous features which are reproduced to some extent in a combined manner in the individual sub-claims. However, these features may also be expediently considered separately and usefully combined in other ways. In particular, these features can be combined individually and in any suitable combination with the inventive method and the inventive apparatus as claimed in the independent claims.

The above described characteristics, features and advantages of this invention, as well as the ways and means of achieving them, will become clearer and more readily comprehensible in conjunction with the following description of the exemplary embodiments which will be explained further with reference to the accompanying drawings. The exemplary embodiments serve to explain the invention and do not limit the invention to the combination of features detailed therein, including functional features. Moreover, suitable features of each exemplary embodiment can also be considered in an explicitly isolated manner, removed from an exemplary embodiment, introduced into another exemplary embodiment and/or combined with any of the claims.

DESCRIPTION OF THE INVENTION

Figure 1:
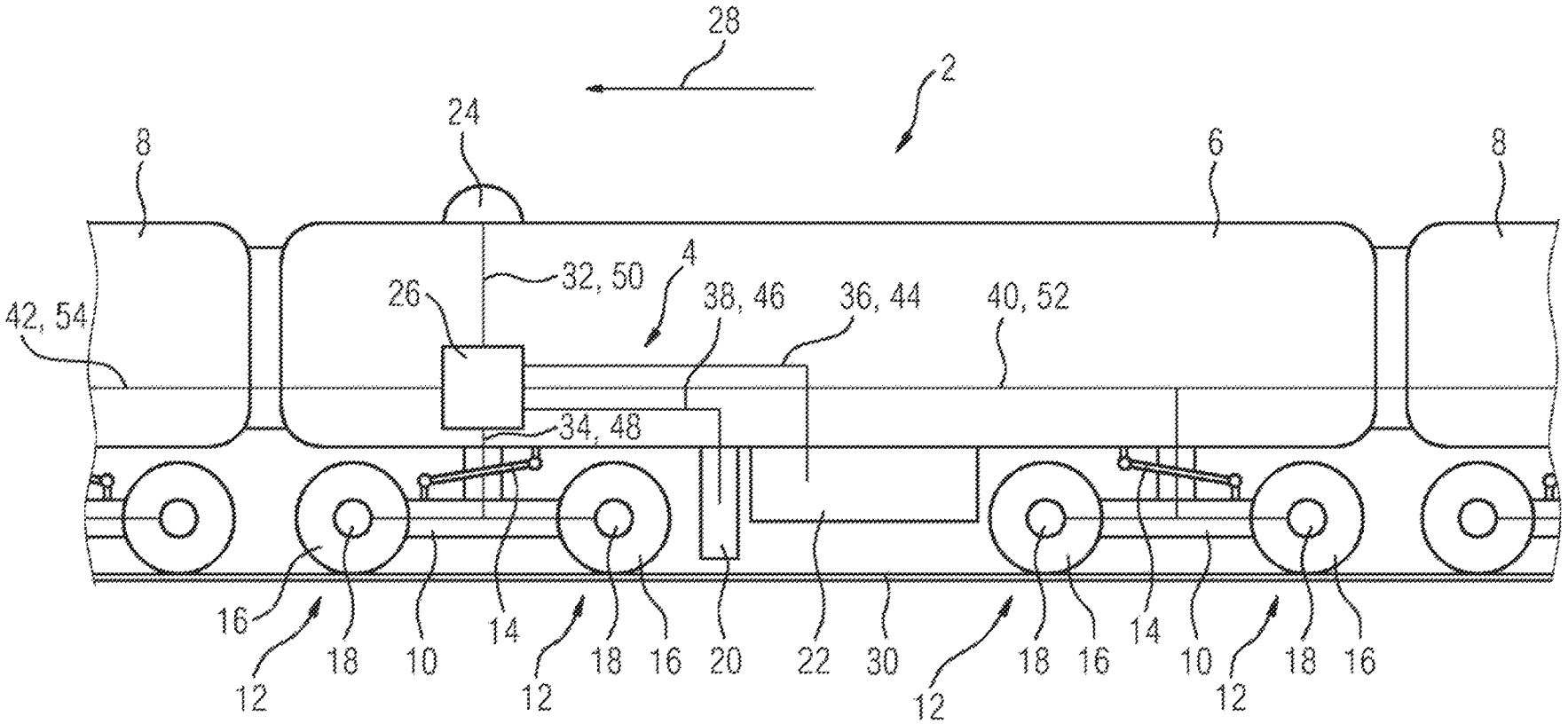
FIG. 1 shows a rail vehicle having an arrangement for stabilizing the rail vehicle, FIG. 2 schematically illustrates a control loop for stabilizing the rail vehicle from FIG. 1, FIG. 3 schematically illustrates a speed curve of the rail vehicle from FIG. 1 according to the method, FIG. 4 schematically illustrates another speed curve according to the method, with reductions of the speed to predetermined values, FIG. 5 schematically illustrates another speed curve with a predetermined speed restriction and FIG. 6 schematically illustrates an exemplary method sequence.

FIG. 1 shows a rail vehicle 2 having an arrangement 4 for stabilizing the rail vehicle 2. In this exemplary embodiment, the rail vehicle 2 comprises a plurality of cars 6, 8 of which, for representational simplicity, only one car 6 is shown completely and two other cars 8 partially. Obviously it is also conceivable for the rail vehicle to have just a single car which can be a locomotive, a freight car or similar.

The rail vehicle 2 has two pivoted trucks 10 mounted on the underside of the car 6, each having a wheel set 12. Each truck 10 is connected to the car 6 via a damper 14 for damping rotary motion. Each of the wheel sets 12 comprises two wheels 16 interconnected in a torsionally rigid manner via an axle, only one wheel being visible in each case in the side view selected.

The arrangement 4 for stabilizing the rail vehicle 2 comprises a plurality of determining devices 18, a track monitoring device 20 and a control unit 26. A drive unit 22 and a position determining device 24 of the rail vehicle 2 can optionally also be regarded as integral parts of the arrangement 4.

In this exemplary embodiment, the determining devices 18 are disposed on the trucks 10, or more precisely on the wheels 16 of the wheel sets 12, and are each designed to determine a vibration state variable of a respective wheel set 12. In this example, the vibration state variable is a lateral acceleration running essentially at right-angles to the direction of travel 28 of the rail vehicle 2 and in particular horizontally.

The track monitoring device 20 is an instrument designed to detect a geometry defect of a track 30 describing a deviation of the position of the track 30 from a nominal position in a horizontal or vertical direction.

The drive unit 22 is designed to accelerate or decelerate the rail vehicle 2. In contrast to the previous exemplary embodiment, a rail vehicle can also have a plurality of drive units which can be disposed, for example, on the trucks or distributed over individual cars of the rail vehicle.

The position determining device 24 is a receiving unit for receiving signals for satellite-based determination of a current position of the rail vehicle 2.

The control unit 26 is connected to the position determining device 24, the determining devices 18 of the front truck 10 of the car 6 in the direction of travel 28, the drive unit 22 or the track monitoring device 20 by means of the signal connections 32, 34, 36 and 38. The control unit 26 is also connected via the signal connections 40 and 42 to the determining devices 18 of the rear truck 10 in the direction of travel 28 and possibly to other determining devices, particularly those which are present in the other cars 8 of the rail vehicle 2. It is self-evidently also conceivable for each car of the rail vehicle, each truck of a car, each wheel set of a truck or each wheel of a wheel set to have a separate control unit.

The control unit 26 is designed to control the drive unit 22 with a control signal 44 via the signal connection 36 for accelerating or decelerating the rail vehicle 2 using the measuring signals 46, 48 and the position signal 50, i.e. GPS information 50. This setup is also designed for using measuring signals 52 and 54 conveyed via the signal connections 40 and 42 respectively.

Figure 2:
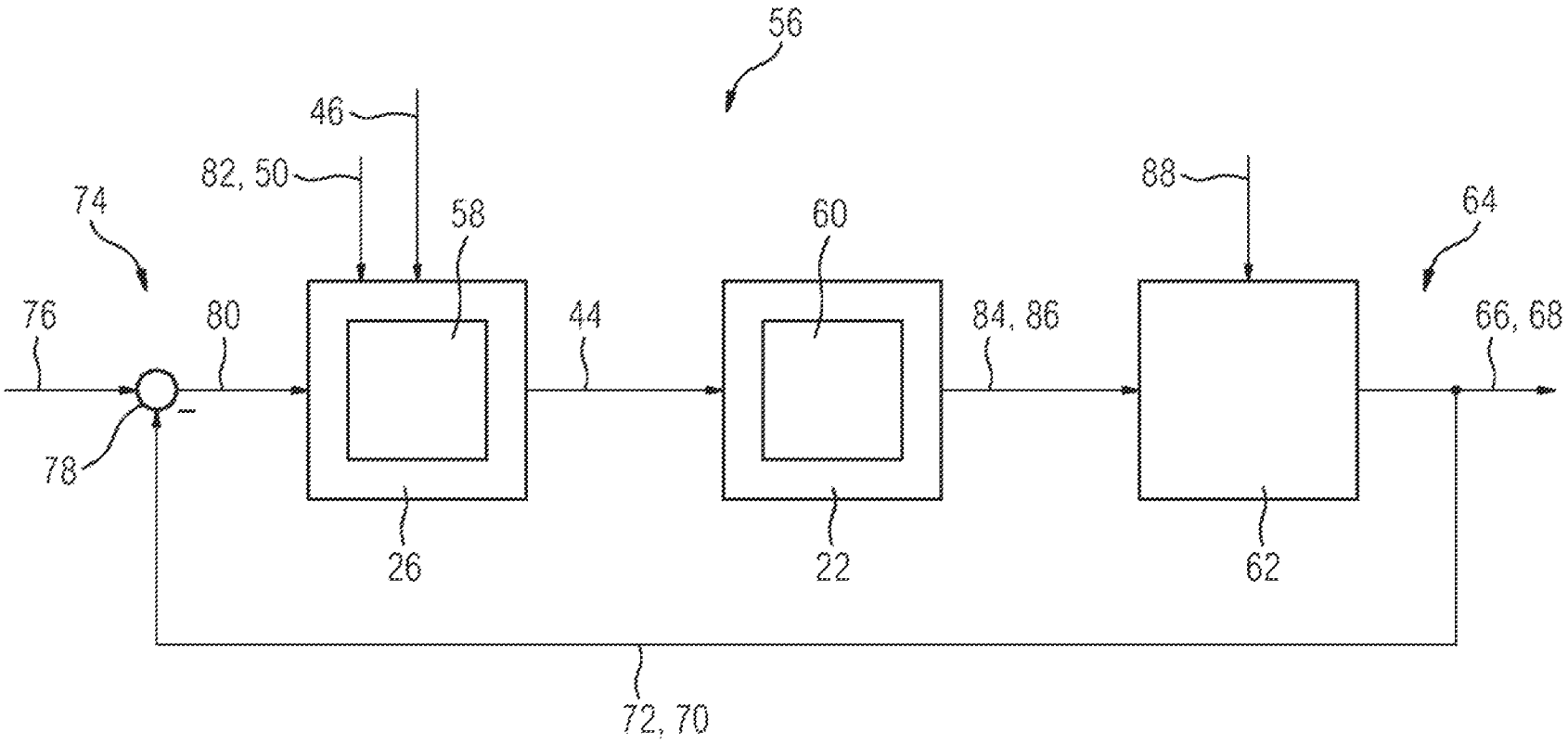

FIG. 2 schematically illustrates a control loop 56 for stabilizing the rail vehicle 2 from FIG. 1. The control loop 56 comprises a controller 58, a final control element 60 and a controlled system 62.

The controller 58 is a component part of the control unit 26 described in the previous exemplary embodiment with reference to FIG. 1. The final control element 60 is a component part of the drive unit 22 and the controlled system 62 is a vibration state of a wheel set 12 of the rail vehicle 2. It is also conceivable to describe the controlled system 62 generally as the driving state of the rail vehicle 2, truck or wheel set vibration or similar.

At the output 64 of the control loop 56, a vibration state variable 66 is present as the controlled variable 68 which in this exemplary embodiment is an acceleration of a wheel 16 of the rail vehicle 2 perpendicular to the direction of travel 28. This (lateral) acceleration 66 is advantageous for instrument-based detection of an instability or rather sinusoidal hunting oscillation of the rail vehicle 2.

The controlled variable 68, i.e. acceleration, is determined at the output 64 of the control loop 56 and returned as a measured variable 70 via a feedback path 72 to the input 74 of the control loop 56. This instrument-based determination of the acceleration or rather of the measured variable 70 is performed by the determining device 18 on a wheel set 12 of the rail vehicle 2.

Additionally present at the input 74 of the control loop 56 is a command variable which in this exemplary embodiment is a predetermined limit value 76 of the acceleration of the wheel set 12. After calculation of the difference 78, the difference between the measured variable 70 and the limit value 76 is fed to the controller 58—i.e. the control unit 26—as the deviation 80. Self-evidently, it is also conceivable for the calculation of the difference 78 to be performed by a function of the control unit 26.

The controller 58 or rather the control unit 26 generates the control signal 44 (see also FIG. 1) using the deviation 80 obtained in this way, i.e. implicitly using the vibration state variable 66, i.e. the controlled variable 68, and uses it to control the final control element 60, i.e. the drive unit 22.

In this exemplary embodiment, the controller 58 also uses GPS information 82 or the measuring signal 50 and the measuring signal 46 of the track monitoring device 20 to generate the control signal 44. The final control element 60 then outputs a manipulated variable 84, i.e. the drive unit 22 decelerates or accelerates the rail vehicle 2 so that the manipulated variable 84 in the form of a changed speed 86 acts on the controlled system 62, i.e. the wheel set, 12.

Because of the changed speed 86, the controlled system 62 changes its state, i.e. a now changed vibration state 66 of the wheel set 12 ensues which is in turn recorded and fed back as a changed (lateral) acceleration—which is not to be confused with a longitudinal acceleration in the direction of travel 28 of the rail vehicle 2.

In addition, a disturbance variable 88 acts on the controlled system 62 or on the wheel set 12. The disturbance variable 88 is here a force applied to the wheel set 12, or more precisely a braking or acceleration force produced by the drive unit 22 as a result of the control signal 44.

The feedback control process described is run continuously or quasi-continuously for a large number of consecutive points in time until alignment between the measured variable 70 and the limit value 76 is established.

Figure 3:
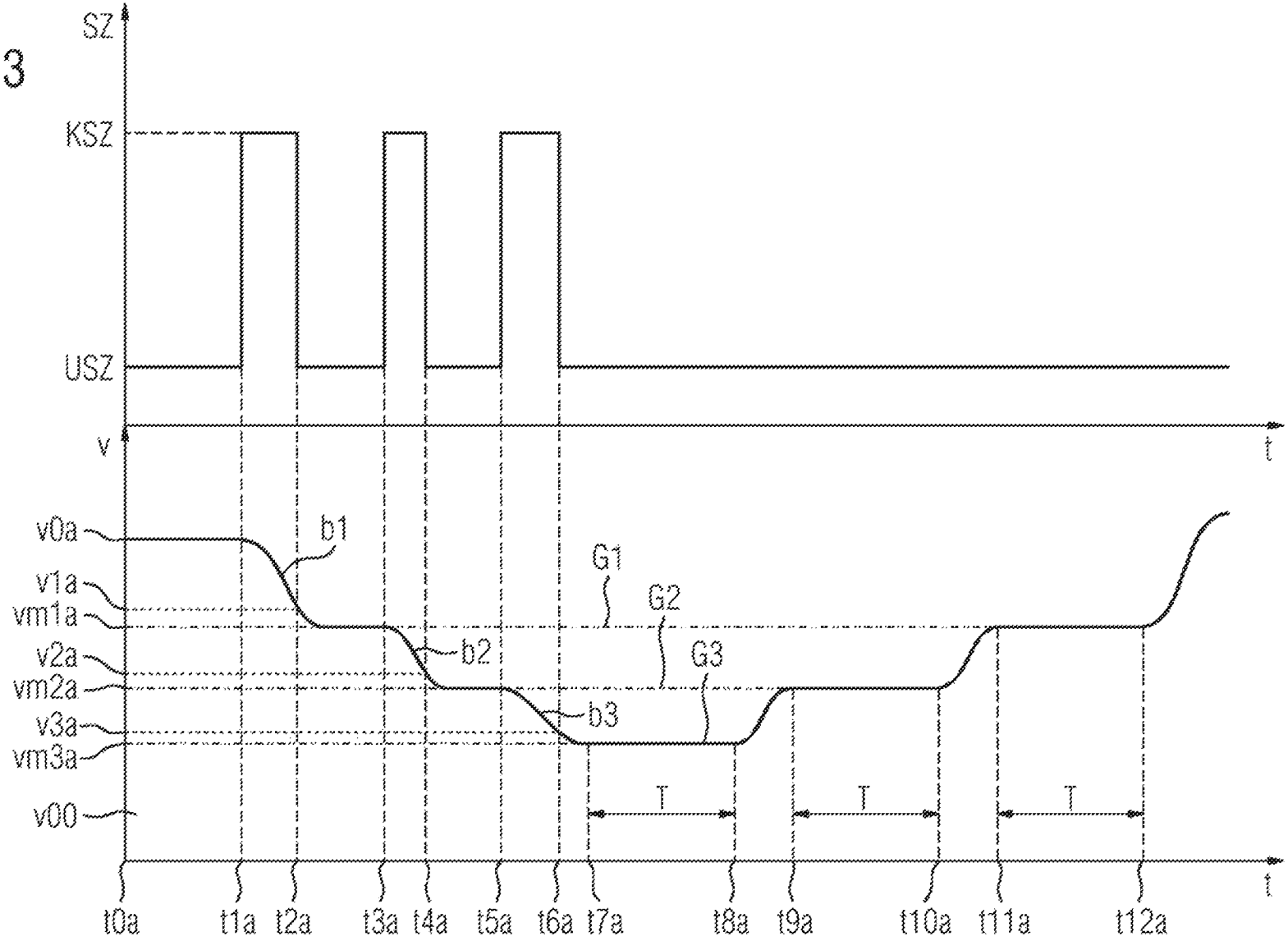

FIG. 3 schematically illustrates a characteristic curve of the speed v (84, 86, cf. FIG. 2) of the rail vehicle 2 from FIG. 1 according to the method. It additionally shows a corresponding time characteristic of a vibration state SZ (66, 68, 70, cf. FIG. 2). Both curves are plotted over time t, both abscissae of the diagram being identical.

Here the speed v is the speed 86 of the rail vehicle 2 and the vibration state SZ is the state of the vibration variable 66 or more specifically the (lateral) acceleration of a wheel set 12 of the rail vehicle 2.

As a fully realistic representation of the vibration state SZ over time t is unnecessary at this juncture for explaining the method and for the sake of better representability, the SZ response is illustrated in a greatly simplified manner. Consequently, the response of the vibration state SZ only reflects the change between two discrete states, namely a critical vibration state KSZ and a non-critical vibration state USZ.

At a time t0*a*, the rail vehicle 2 (see FIG. 1) is moving at a speed v0*a*, wherein a non-critical vibration state USZ of the rail vehicle 2 or of the wheel set 12 obtains.

The same features which may, however, exhibit slight differences, e.g. in terms of absolute or numerical value, dimension, position and/or function or the like, are labeled with the same reference numerals and other reference characters. If the reference numeral is mentioned alone without a reference character, this applies to the corresponding components of all the exemplary embodiments.

At a time t1*a*, a critical vibration state KSZ occurs and the speed v of the rail vehicle 2 is reduced according to the method, e.g. using the control process described in FIG. 2. The speed v is reduced until the vibration state SZ attains a non-critical value USZ, which is the case at time t2*a* for a speed v1*a*.

The braking of the rail vehicle 2 between t1*a* and t2*a* and the associated frictional forces between wheel 16 and track 30 can produce an effect on the vibration state SZ. It may therefore happen that the rail vehicle 2 is stabilized by a braking operation and the accompanying reduction in the speed v, but after an at least predominant reduction of the braking force—i.e. in the event of at least partial releasing of the brake—a critical vibration state KSZ re-occurs.

In order to prevent this, depending on the speed v1*a* reduced in this way, a maximum speed vm1*a*, where vm1*a*<v1*a*, is determined and set as a speed restriction G1 for the rail vehicle 2 until further notice. The rail vehicle 2 accordingly moves at a speed vm1 until time t3*a*.

At time t3*a*, a critical vibration state KSZ re-occurs, the speed v of the rail vehicle 2 is reduced once again until the vibration state SZ attains a non-critical value USZ, which is the case at time t4*a* for a speed v2*a*. Again, depending on the speed v2*a* reduced in this way, a maximum speed vm2*a*, where vm2*a*<v2*a*, is determined and set as a speed restriction G2 for the rail vehicle 2 until further notice. The rail vehicle 2 accordingly moves at a speed vm2 until time t5*a*.

At time t5*a*, a critical vibration state KSZ re-occurs, the speed v of the rail vehicle 2 is reduced once again until the vibration state SZ attains a non-critical value USZ, which is the case at time t6 for a speed v3*a*. Again, depending on the speed v3*a* reduced in this way, a maximum speed vm3*a*, where vm3*a*<v3*a*, is determined and set as a speed restriction G3 for the rail vehicle 2 until further notice.

The rail vehicle 2 accordingly moves at a speed vm3*a* from time t7*a* until further notice. Should a lower speed v be required for track- or schedule-related reasons, the speed can obviously be reduced appropriately or the rail vehicle brought to a stand.

At time t8*a*, the speed v is increased again, as the rail vehicle 2 has remained within a non-critical vibration state range USZ for a predefined travel span T.

That is to say, at time t8*a* the speed restriction G3 set at time t6*a* is removed or canceled and the rail vehicle 2 is accelerated. The rail vehicle 2 is accelerated up to the speed restriction G2 set at time t4*a* and still in force and reaches it at time t9*a*.

At time t10*a*, the speed v is increased again, as the rail vehicle 2 has remained within a non-critical vibration state range USZ for a further predefined travel span T. At this time t10*a*, the speed restriction G2 set at time t4*a* is removed and the rail vehicle 2 is accelerated. The rail vehicle 2 is accelerated up to the speed restriction G1 set at time t2*a* and still in force and reaches it at time t11*a*.

After another travel span T has been stably negotiated between times t11*a* and t12*a*, the last remaining speed restriction G1 is removed and the rail vehicle 2 is accelerated.

In this exemplary embodiment, the predetermined travel span T is a time span between two points in travel time. However, it is also possible for the travel span to be a distance between two points on the route of the rail vehicle 2.

It is also desirable to bring about stabilization of the rail vehicle 2 whilst minimizing inevitably occurring disturbance variables (88, see FIG. 2). Such disturbance variables can be, in particular, forces applied to the wheel set 12 which occur in an impulsive, fluctuating, transient or similar manner.

The speed v is therefore reduced with an essentially constant deceleration b1, b2 or b3 between the times t1*a* and t2*a*, t3*a* and t4*a* and t5*a* and t6*a* respectively. This allows steadying of the braking forces acting on the wheel set 12 during braking, so that the effect of braking force fluctuations as a disturbance variable 88 affecting the stabilization of the rail vehicle 2 or the controlled system 62 is minimized.

It is possible that normal driving states of the rail vehicle 2 at low or moderate speeds v, e.g. when negotiating a switch, briefly produce a critical vibration state KSZ.

In order to prevent a method-related change in the speed as a result of such driving states, the speed is only changed if a critical vibration state KSZ occurs above a predetermined minimum speed v00.

Figure 4:
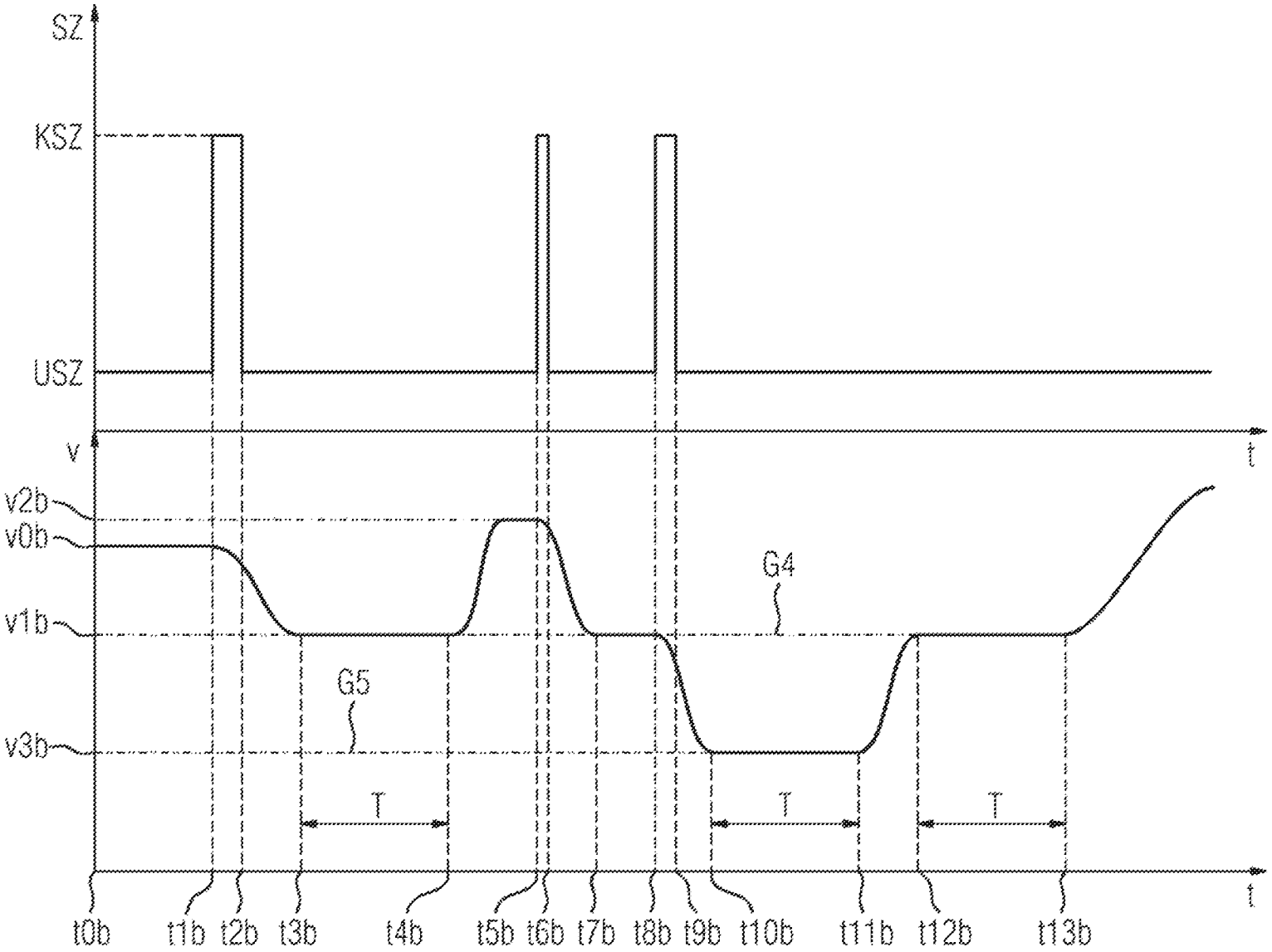

FIG. 4 schematically illustrates another speed characteristic v according to the method and a corresponding characteristic of a vibration state SZ, in each case over time t, wherein the two abscissae of the diagram are again identical. The following descriptions are essentially limited to the differences compared to the preceding exemplary embodiments, to which the reader is referred with regard to features and functions that remain unchanged.

In contrast to the exemplary embodiment illustrated in FIG. 3, here the speed is reduced to predetermined, discrete speed values, thereby enabling a simplified implementation of the method, in particular a simplified translation of parts of the method into software program code, to be achieved.

In respect of the simplified illustration of the time characteristic of the vibration state SZ, the explanations relating FIG. 3 apply.

At a time t0*b*, the rail vehicle 2 (see FIG. 1) is moving at a speed v0*b*, wherein a non-critical vibration state of the wheel set 12 or a stable running of the rail vehicle 2 obtains.

At a time t1*b*, a critical vibration state KSZ occurs and the speed v of the rail vehicle 2 is reduced. The speed v is reduced to a predetermined speed value v1*b* which is used until further notice as a predetermined speed restriction G4 which is reached at time t3*b*. A non-critical vibration state USZ is achieved as early as time t2*b*, where t2*b*<t3*b*.

At time t4*b*, the speed v is increased again and the speed restriction G4 is removed, as the rail vehicle 2 has run within a non-critical vibration state range USZ for a predefined travel span T. The speed v is increased to a speed value v2*b*, where v2*b*>v0*b*, wherein an external—i.e. non-method-related—circumstance is the decisive factor for specifying v2*b*.

At time t5*b*, a critical vibration state KSZ re-occurs and the speed v of the rail vehicle 2 is reduced once more. The speed v is again reduced to the predetermined speed value v1*b* which in turn is used as speed restriction G4 at time t7*b*. A non-critical vibration state USZ is achieved as early as time t6*b*, where t6*b*<t7*b*.

At time t8*b*, a critical vibration state KSZ re-occurs and the speed v of the rail vehicle 2 is reduced once again. The speed v is reduced to a predetermined speed value v3*b* which is used as speed restriction G5 at time t10*b*. A non-critical vibration state USZ is achieved as early as time t9*b*, where t9*b*<t10*b*.

Then, after passing travel span T, at time t11*b* the speed is increased to v1*b* by removing the speed restriction G5.

After passing a further travel span T between times t12*b* and t13*b*, the remaining speed restriction G4 is also removed and the rail vehicle 2 is accelerated.

Figure 5:
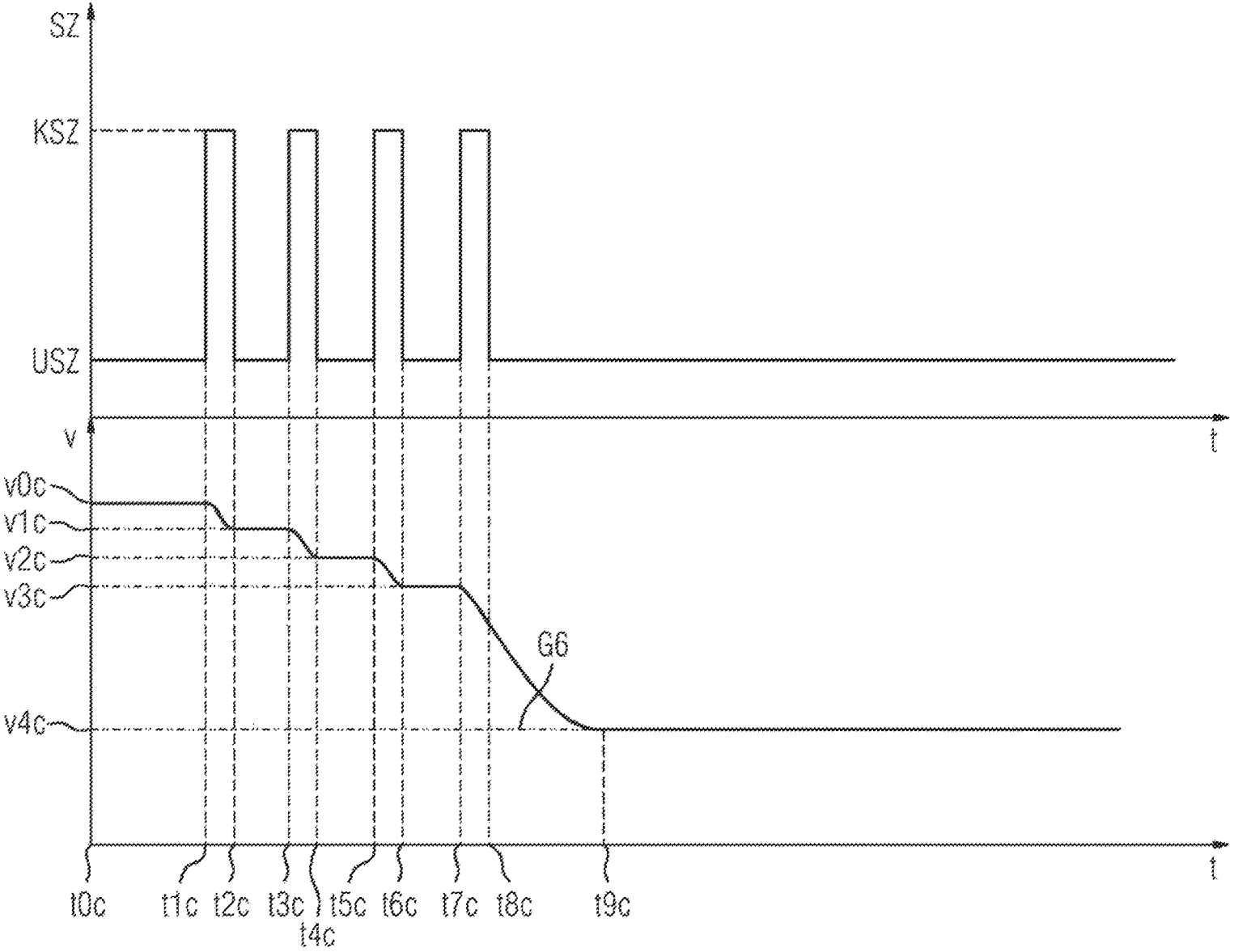

FIG. 5 schematically illustrates another speed characteristic v and a corresponding characteristic of a vibration state SZ.

In contrast to the exemplary embodiments illustrated by means of FIG. 3 and FIG. 4, here the speed is permanently restricted to a predetermined, significantly reduced speed value following repeated occurrences of a critical vibration state KSZ. This makes it possible to prevent speed-induced overstressing of worn components of the rail vehicle 2 and/or safety-critical driving states.

Starting from a speed v0*c*, if critical vibration states KSZ occur, the speed v of the rail vehicle 2 is successively reduced at times t1*c*, t3*c* and t5*c* to the speed values v1*c*, v2*c* and v3*c* which are attained at times t2*c*, t4*c* and t6*c* respectively.

At time t7*c*, an instability or a critical vibration state KSZ re-occurs. Because of the now repeated instability of the rail vehicle 2, the speed v is decreased to a predetermined, significantly reduced speed value v4*c*, wherein the critical vibration state KSZ occurring at time t7*c* is exited as early as time t8*c*.

The speed value v4*c* thus attained at time t9*c* is set as a speed restriction G6 and the rail vehicle 2 is operated at no more than this speed until further notice.

Figure 6:
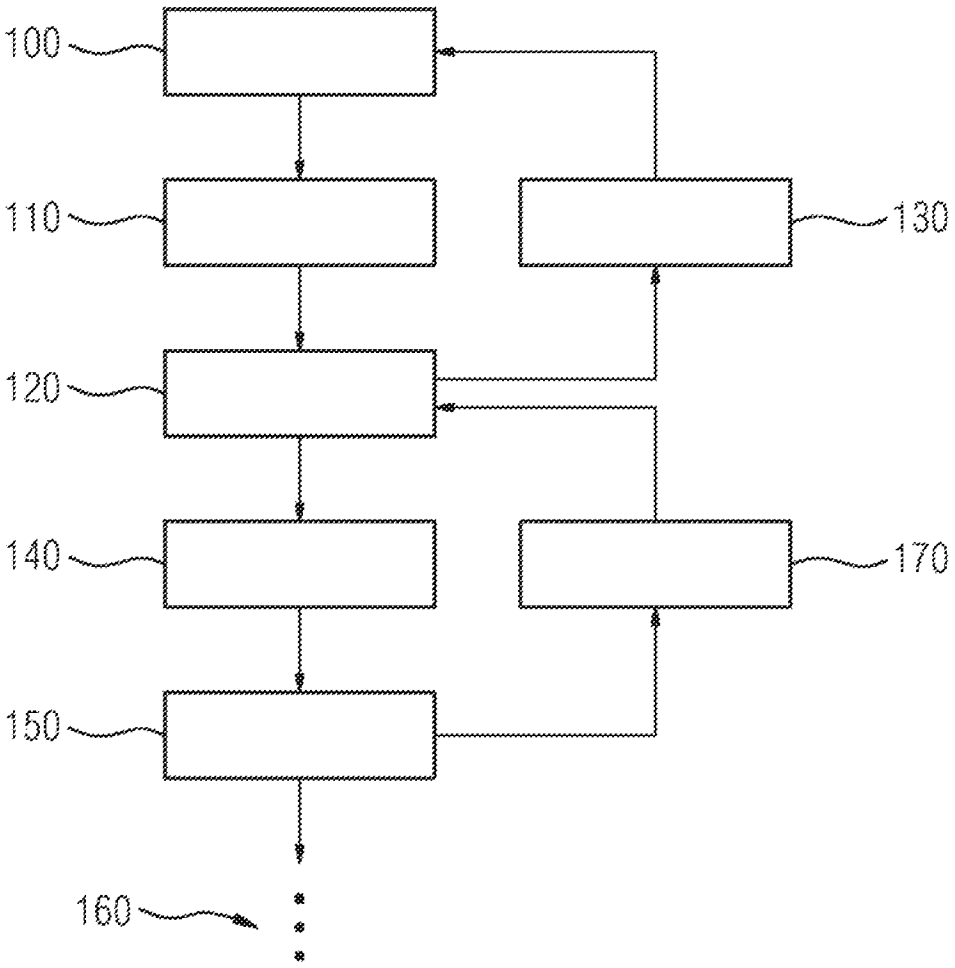

FIG. 6 schematically illustrates an exemplary method sequence. The rail vehicle 2 is initially moving at a speed v (cf. FIG. 3, v0*a*) in a stable driving state (cf. FIG. 3, USZ). Accordingly, in this method step 100 no method-related speed restriction is set or active.

If a critical speed state KSZ of the wheel set 12 occurs, the speed v0*a* is changed 110 using a vibration state variable 66, or more precisely the acceleration—i.e. the controlled variable 68. The speed is reduced until the vibration state variable 66 reaches a predetermined limit value (cf. FIG. 2, 76).

In the next step, a maximum speed (e.g. vm1*a*) different from the changed speed which can be v1*a*, for example (see FIG. 3), is determined and set 120 as a speed restriction (cf. G1, FIG. 3). The rail vehicle 2 is operated at a speed not exceeding this speed restriction until further notice.

If the rail vehicle 2 has remained within a non-critical vibration state range of the wheel set 12 for a predefined travel span (cf. e.g. FIG. 3, T), the speed restriction previously determined and set 120 is lifted 130 and the speed of the rail vehicle 2 is increased as required.

If an instability re-occurs before the predetermined travel span has been completed, the speed is reduced again 140. Another speed restriction is determined and set 150.

The method steps of changing a speed and setting a speed restriction are repeated if further instabilities occur before predetermined travel spans have been completed. This is repeated until, for example, a maximum number of speed restrictions have been set, the speed has reached or fallen below a predetermined minimum speed or similar. Continuation 160 of the method is indicated by dots in FIG. 3.

If, starting from the setting 150 of the speed restriction, the rail vehicle 2 has remained within a non-critical vibration state range over a predefined travel span, the latest speed restriction determined and set 150 is lifted or canceled 170. However, the speed restriction determined and set 120 remains activated.

If the rail vehicle 2 again completes the predetermined travel span without instabilities occurring, this speed restriction is lifted 130. Thereafter, all the speed restrictions according to the method are inactive and the vehicle again operates in state 100.

The invention claimed is:

1. A method for stabilizing a rail vehicle having a wheel set, which comprises the steps of:

changing a speed of the rail vehicle if a critical vibration state of the wheel set occurs;

changing the speed of the rail vehicle using a vibration state variable of the wheel set; and permanently reducing the speed to a predefined speed value if the critical vibration state of the wheel set occurs repeatedly.

2. The method according to claim 1, which further comprises using the vibration state variable as a controlled variable for changing the speed.

3. The method according to claim 1, wherein the vibration state variable is an acceleration running generally perpendicular to a direction of travel of the rail vehicle.

4. The method according to claim 1, which further comprises determining a maximum speed of the rail vehicle that is different from a changed speed in dependence on the changed speed.

5. The method according to claim 4, which further comprises determining the maximum speed as the changed speed multiplied by a safety factor.

6. The method according to claim 1, which further comprises:

reducing the speed;

measuring the vibration state variable during the reducing of the speed; and reducing the speed until the vibration state variable falls below a predetermined limit value due to the reducing of the speed.

7. The method according to claim 1, which further comprises changing the speed to a discrete speed value.

8. The method according to claim 1, which further comprises reducing the speed with a constant deceleration.

9. A method for stabilizing a rail vehicle having a wheel set, which comprises the steps of:

changing a speed of the rail vehicle if a critical vibration state of the wheel set occurs;

changing the speed of the rail vehicle using a vibration state variable of the wheel set; and only reducing the speed when the critical vibration state of the wheel set occurs above a predetermined minimum speed.

10. The method according to claim 1, which further comprises changing the speed of the rail vehicle using global positioning satellite information for a current position of the rail vehicle.

11. The method according to claim 1, which further comprises changing the speed of the rail vehicle using a measuring signal of an on-board track monitoring device.

12. The method according to claim 1, which further comprises changing a damping of a vibration of the rail vehicle.

13. The method according to claim 1, wherein the changing in the speed is made functionally dependent on the vibration state variable.

14. The method according to claim 1, wherein the stabilizing is an attenuation of a lateral vibration of the wheel set of the rail vehicle.

15. The method according to claim 1, which further comprises incrementally changing the speed to a discrete speed value.

* * * * *